US006359766B1

(12) United States Patent
Youngman et al.

(10) Patent No.: US 6,359,766 B1
(45) Date of Patent: Mar. 19, 2002

(54) APPARATUS FOR PROPER GROUNDING OF TWISTED PAIR CABLING

(75) Inventors: Todd Jason Youngman; Patrick James Zuroski, both of Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/518,064

(22) Filed: Mar. 2, 2000

(51) Int. Cl.[7] ..... H01C 7/10
(52) U.S. Cl. ..... 361/119
(58) Field of Search ..... 361/58, 62, 63, 361/65, 118, 119

(56) References Cited

U.S. PATENT DOCUMENTS 4,580,186 A * 4/1986 Parker et al. ..... 361/62
5,675,486 A * 10/1997 Chang ..... 361/119
5,886,431 A * 3/1999 Rutigliano ..... 361/58 X

* cited by examiner

*Primary Examiner*—Edward H. Tso
(74) *Attorney, Agent, or Firm*—James R. Nock

(57) ABSTRACT

An apparatus for grounding network cabling prior to insertion in a network device. The apparatus includes a cable connector receptor for receiving a standardized network cable connector. The apparatus also includes a current limiting device coupled to the cable connector receptor for reducing any electrical potential present on the cable. The current limiting device is coupled to electrical ground via a ground connector which provides a discharge path for any electrical potential present on the cable. In alternative embodiments, the apparatus can exist as a standalone device, as an integrated feature of a grounding wrist strap, or as an integrated feature of a computer system or network hub.

28 Claims, 7 Drawing Sheets

STEP A - Ground Cable via Grounding Apparatus

APPARATUS FOR PROPER GROUNDING OF TWISTED PAIR CABLING

TECHNICAL FIELD

This invention relates generally to the connection of network devices and more particularly relates to an apparatus for properly grounding network cabling prior to connection to a network device.

BACKGROUND OF THE INVENTION

In the past few years, local area networks (LANs) have gone from being an experimental technology to becoming a key business tool used by companies worldwide. A LAN is a high-speed communications system designed to link computers and other data processing devices together within a small geographic area such a workgroup, department, or a single floor of a multistory building. Several LANs can also be interconnected within a building or campus of buildings to extend connectivity.

Local area networking is a shared access technology. Shared access means that all of the devices attached to the LAN share a single communications medium, usually a coaxial, twisted pair, or fiber optic cable. The physical connection to the network is made by putting a network interface card (NIC) inside of the device to be attached, then connecting the cable to the device via a standardized connector.

The most widely-used LAN technology today is Ethernet. Ethernet networks are typically configured in either a star or bus topology. Coaxial cable was the original LAN medium and is typically used in the bus topology. In this configuration, the coaxial cable forms a single bus to which all stations are attached. This topology is rarely used in new LAN installations today because it is relatively difficult to accommodate adding new users or moving existing users from one location to another. It is also difficult to troubleshoot problems on a bus LAN unless it is very small.

Today, a star topology LAN is typically employed. In a star topology, each device is connected to a central wiring concentrator, or hub, by an individual length of twisted pair cable. The cable is connected to the device's network interface card (NIC) at one end and to a port on the hub at the other. The hubs are typically placed in wiring closets centrally located in a building.

As a result of the relatively long lengths of network cabling and circuitous routing often employed in LAN configurations, network cabling is often susceptible to buildups of electrical potential. If these buildups of electrical potential are not properly discharged, electrostatic discharge events can occur upon connection of the network cabling to network devices (e.g., network adapter cards, and hubs). The excess charge is then grounded through the networking device. If the excess charge is sufficient, damage to the electrical components of the networking device can occur. Also, the tighter circuit geometries incorporated within semiconductors used within today's networking devices has increased the susceptibility of such devices to electric discharge.

Networking devices can incorporate discharge protection circuits to mitigate the problem of electric discharge upon connection to network cabling. But, today's competitive environment has driven the price of networking devices to all-time lows, so manufacturers are often forced to make design tradeoffs in order to produce a low cost product. The addition of discharge protection circuits to a typical networking device can significantly increase the production costs of the device, thus the majority of such devices do not incorporate discharge protection circuits.

Thus, there is a need for an apparatus to provide proper grounding of network cabling prior to connection to a network device. The apparatus should be small, quick, easy to use, and cost effective. The apparatus should be independent from the network device. Finally, the apparatus should support industry standard network cable connectors, and provide a relatively large discharge capability.

These and other objects, features and advantages of the present invention will be further described and more readily apparent from the summary, detailed description and preferred embodiments, the drawing and the claims which follow.

SUMMARY OF THE INVENTION

The present invention provides an apparatus for grounding shielded and unshielded twisted pair cabling prior to connection to a network device, such as a network interface card (NIC) or a network hub, preventing electrostatic discharge (ESD) damage to the network device. In one embodiment, a cable connector receiver is mounted on an edge of a printed circuit board. A user inserts a cable connector attached to the end of each potentially charged twisted pair cable into the cable connector receiver. A current limiting device (also mounted on the printed circuit board) coupled to the cable connector receiver discharges any excess electric potential present on the twisted pair cable. In a preferred embodiment, the current limiting device includes a resistor attached to each twisted pair signal line of the cable via the cable connector. A ground connector joins the current limiting device to an electrical ground, thus providing an electrical discharge path to the electrical ground for any excess electric potential present on the cable. After any electric potential present on the cable has been successfully discharged, the user removes the cable from the apparatus and inserts the discharged cable into the network device.

The present invention offers several advantages over the currently implemented solution of installing protection circuits onto the actual networking device. The apparatus is external to and independent from the networking device, enabling use with the ever-increasing number of networking devices that do not incorporate any ESD protection circuits. Also, the apparatus can discharge built up electric discharge potentials with a much larger KV rating than can networking devices with onboard protection circuits. Finally, the apparatus can be implemented within a standalone unit, within a grounding wrist strap, or within the networked device itself.

BRIEF DESCRIPTION OF THE DRAWINGS

FIG. 3A illustrates the insertion of a electrostatically charged cable into a first embodiment of the grounding apparatus. FIG. 3B illustrates insertion of the cable into a network interface card (NIC) after the twisted pair cable has been discharged, as illustrated in FIG. 3A.

DETAILED DESCRIPTION OF THE INVENTION

Figure 1:
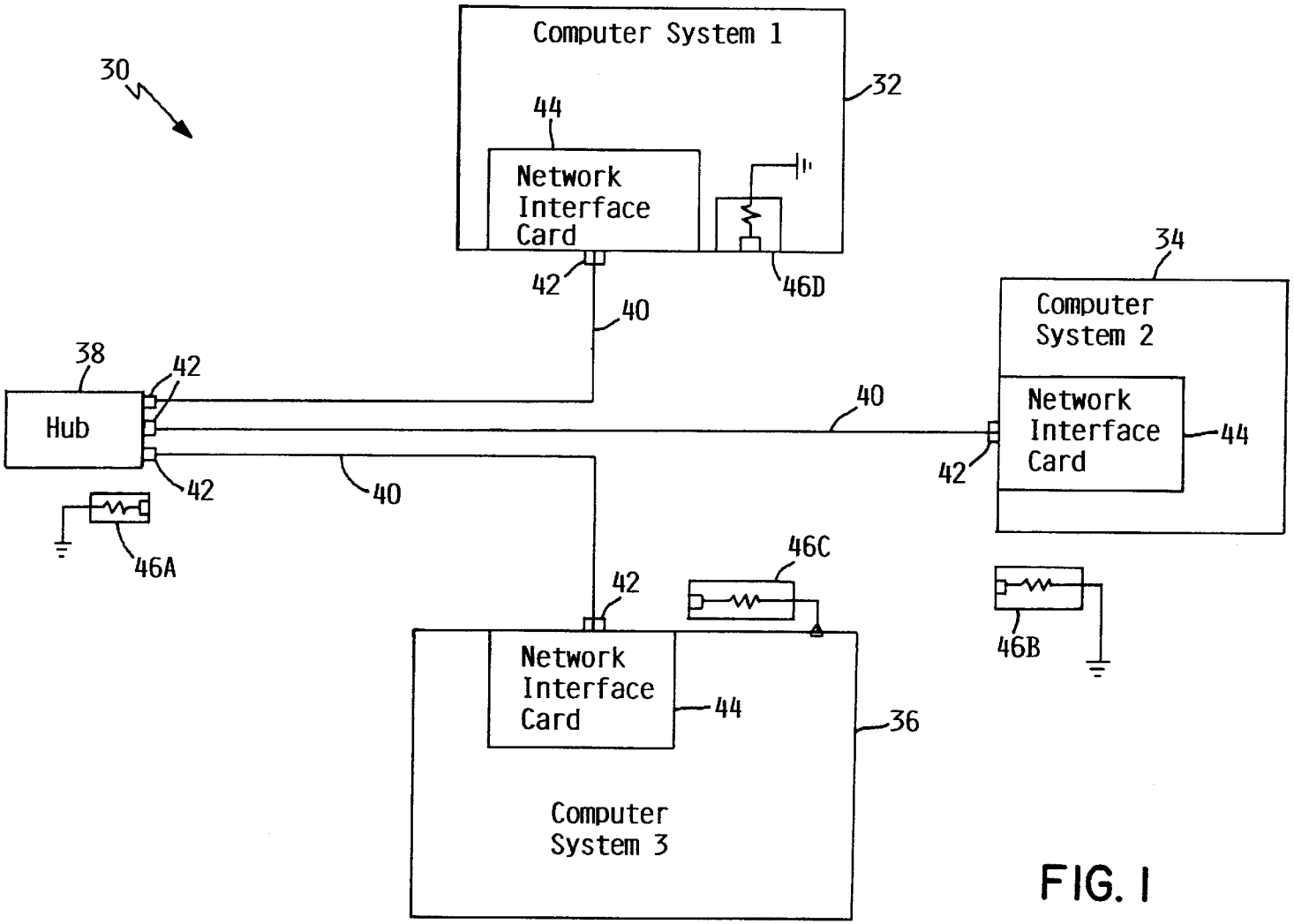
FIG. 1 is a high level block diagram of a Local Area Network (LAN), including embodiments of a network cable grounding apparatus in accordance with the preferred embodiment.

FIG. 1 is a high level block diagram of one embodiment of a Local Area Network (LAN), illustrated generally at 30. LAN 30 includes a plurality of computer systems 32, 34, and 36, connected to a centralized hub 38 by a corresponding plurality of cables 40. Cables 40 are connected to computer systems 32, 34 and 36 via a Network Interface Card (NIC) 44. LAN 30 of FIG. 1 is for illustrative purposes only, the present invention can be utilized within a variety of LAN configurations and equipment types.

In the illustrated embodiment, cables 40 are unshielded Ethernet network cables (e.g., Category 3, Category 5, Category 5 Enhanced, etc.) which include four twisted pairs of copper wire terminated on each end with a Registered Jack-45 (RJ-45) connector 42. It is contemplated that a wide variety of cables 40 in addition to Ethernet network cables can be successfully utilized within the scope of present invention.

Unshielded twisted pair (UTP) cable used for LANs is similar to telephone cable, but has somewhat more stringent specifications regarding its susceptibility to outside electromagnetic interference (EMI) than common telephone wire. Shielded twisted pair (STP), as its name implies, comes with a shielding around the cable. The preferred embodiment is equally effective with shielded cables.

RJ-45 connectors 42 of the illustrated embodiment look similar to the ubiquitous RJ-11 connectors used for connecting telephone equipment, but are somewhat wider. It is contemplated that a wide variety of connector types in addition to RJ-45 connectors 42 may be successfully employed within the scope of the present invention.

In the illustrated embodiment, each cable 40 can range in length from approximately 1 meter to approximately 100 meters. Other types of cable 40 employed within the present invention may have differing lengths. In a typical implementation, cable 40 is used to connect the computers 32, 34, and 36 of a workgroup or office area to hub 38, and cable 40 is often routed through office walls, false ceilings, and along steel support structures. As a result of the long run lengths and challenging electrostatic environment through which cable 40 is routed, a significant amount of electric potential is built up on cable 40 prior to attaching the cable to computer systems 32, 34, and 36 or hub 38.

As described above, many network interface cards 44 in use today do not incorporate any ESD voltage protection circuits. Even if network interface card 44 includes an ESD voltage protection circuit, the circuit may not adequately protect the network interface card 44 against an electric potential buildup.

Grounding device 46A, 46B, 46C, and 46D provides a quick and inexpensive apparatus for discharging an electric potential present on cable 40 prior to connecting cable 40 to a network device. In a typical scenario, a user inserts an end 42 of cable 40 into grounding device 46A, 46B, 46C or 46D, then removes the end 42 of the discharged cable 40 from grounding device 46A, 46B, 46C or 46D, and reinserts the end 42 of cable 40 into the network device. Various embodiments of grounding device include, but are not limited to: a standalone box 46A and 46B, a device grounded to the chassis of the network device 46C (such as a grounded wrist strap shown in FIG. 4), or a device integrated into the computer system itself 46D (described in greater detail in FIG. 5).

Figure 2:
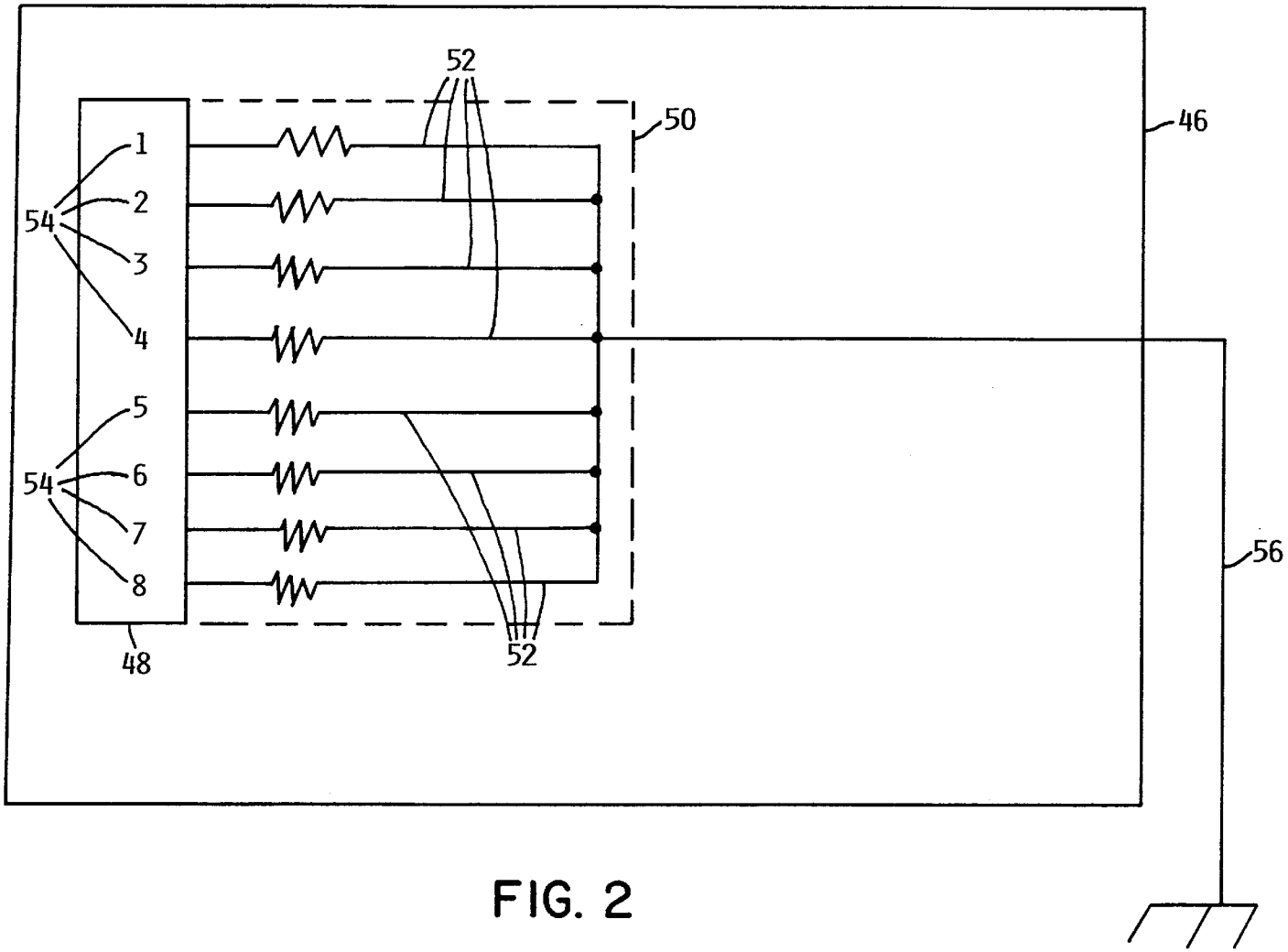
FIG. 2 is a simplified circuit diagram of one embodiment of a network cable grounding apparatus in accordance with the preferred embodiment.

FIG. 2 is a simplified circuit diagram of one embodiment of a twisted pair cable grounding device 46. In the illustrated embodiment, grounding device 46 includes a cable connector receiver 48 for receiving a cable connector (FIG. 1, element 42) of twisted pair cable 40. Cable connector receiver 48 includes a separate signal line 54 for each line present in twisted pair cable 40. Cable connector receiver 48 is typically mounted on one end of a small printed circuit board. In a preferred embodiment, cable connector receiver 48 receives an RJ-45 connector. In alternative embodiments, end connector receiver 48 receives an RJ-11 connector (not shown), or any other type of standard connector.

Grounding device 46 further includes a current limiting device 50 coupled to cable connector 42 which discharges any excess electric potential present on twisted pair cable 40. Current limiting device 50 is typically mounded on the same small printed circuit board where cable connector receiver 48 resides. In a preferred embodiment, current limiting device 50 includes a plurality of resistors 52, each resistor 52 coupled to a twisted pair signal line 54 at cable connector 48. In a preferred embodiment, each resistor 52 has a resistance value of approximately 1 megaohm to approximately 10 megaohms, however, resistance values in alternative embodiments may be less than 1 megaohm and greater than 10 megaohms. In an alternative embodiment, current limiting device 50 includes a plurality of diodes, which perform essentially the same function as resistors 52 described above.

Grounding device 46 also includes a ground connector 56 which provides an electrical discharge path from twisted pair cable 40 to electrical ground. One end of ground connector 56 is coupled to current limiting device 50, while the other end of ground connector 56 is coupled to electrical ground. In one embodiment, the grounded end of ground connector 56 includes an alligator clip for easy attachment to electrical ground.

Figure 3A:
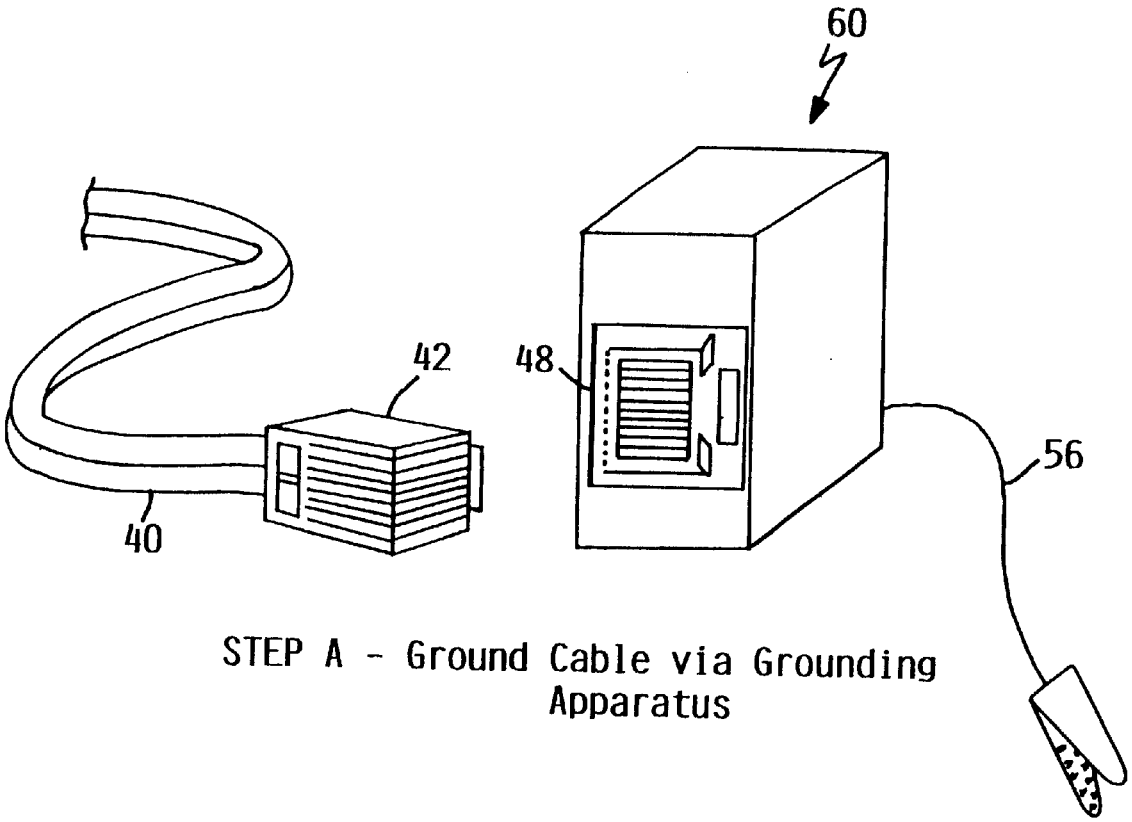
FIGS. 3A and 3B collectively illustrate a two-step procedure for grounding a cable in accordance with the preferred embodiment.
Figure 3B:
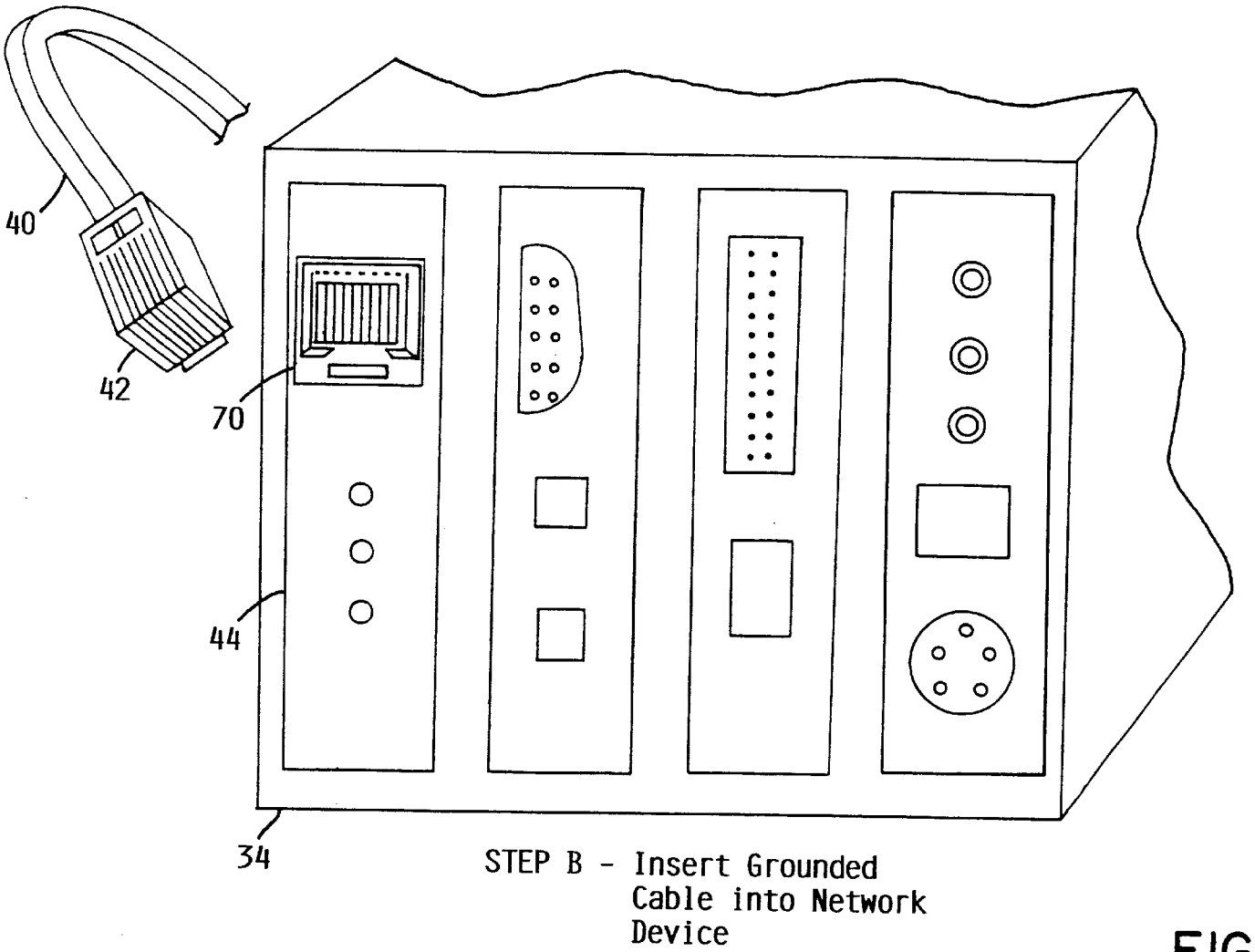

FIGS. 3A and 3B collectively illustrate a two-step procedure for grounding cable 40. FIG. 3A illustrates the insertion of a electrostatically charged cable 40 into a first embodiment of the grounding device, shown generally at 60. In the illustrated embodiment, grounding device 60 is a small, standalone box that is easily transported from site to site. In order to use grounding device 60, a technician simply connects the alligator clip of ground connector 60 to an electrical ground, then inserts connector 42 of the charged cable 40 into cable connector receiver 48. Upon insertion of cable 40 into grounding device 60, any excess electrical charge present on cable 40 is discharged to electrical ground via the current limiting device 50 (e.g., resistors) present within grounding device 60.

FIG. 3B illustrates insertion of cable 40 into network interface card (NIC) 44 of computer system 34 after cable 40 has been discharged by grounding device 60, as previously illustrated in FIG. 3A. Since any excess voltage potential present on cable 40 was removed by the insertion of the cable into grounding device 60, the discharged cable 40 is now safely inserted into a cable connector receiver 70 on network interface card 44. The entire process of inserting/removing cable 40 from grounding device 60, then inserting twisted pair cable 40 into network interface card 44 is performed in a few seconds. Cable 40 may be discharged in a similar manner prior to insertion in a cable connector receiver for hub 38, as illustrated previously in FIG. 1.

Figure 4:
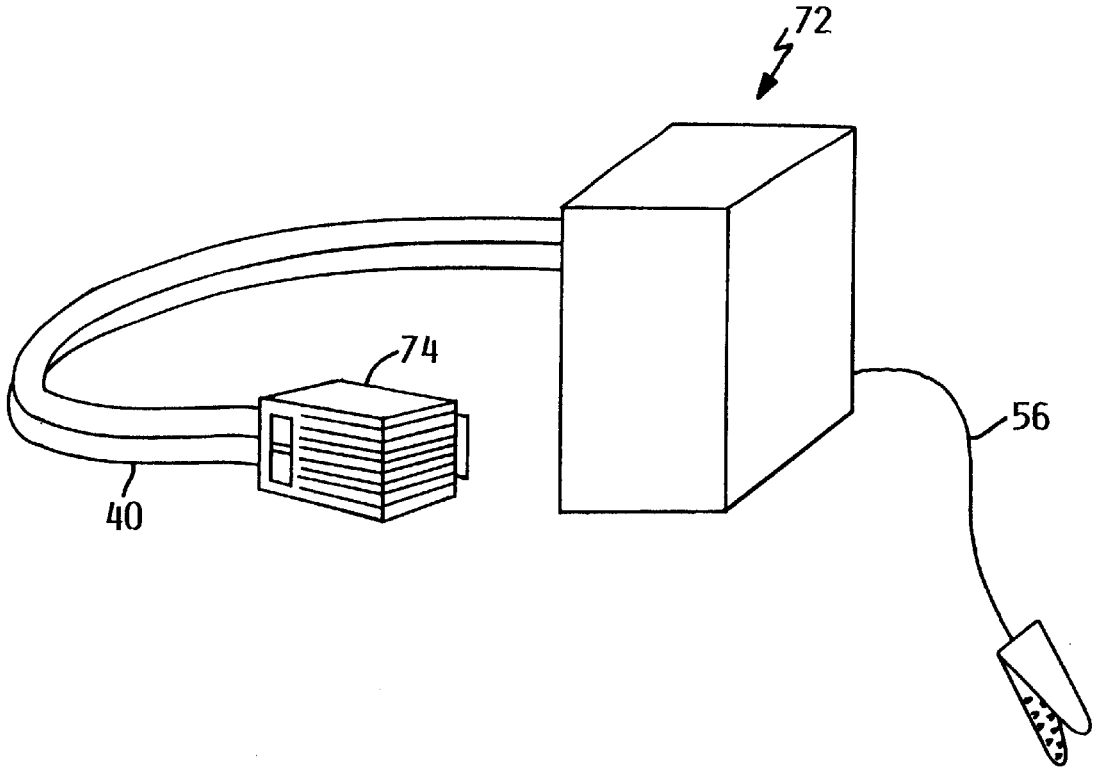
FIG. 4 illustrates a second embodiment of a grounding apparatus, wherein the grounding apparatus incorporates a connector to insertion within a connector receiver for the device to be grounded.

FIG. 4 illustrates a second embodiment of a grounding device, shown generally at 72. In contrast to the grounding device illustrated in FIG. 3A which incorporates a connector receiver 48 into which a cable is inserted, the present embodiment incorporates a connector 74 for insertion into a connector receiver of a device to be grounded. Simply stated, the embodiment of FIG. 3A incorporates a female connector receiver, while the present embodiment incorporates a male connector. In one application of the present embodiment, connector 74 is inserted into a cable connector receiver of a network patch panel box, while ground connector 60 of grounding device 72 is attached to an electrical ground. Any excess electric potential present on the cable attached to the cable connector receiver is drawn off by grounding device 72. It is contemplated that the illustrated embodiment of the grounding apparatus can be implemented within a wide variety of applications where the device to be grounded incorporates a connector receiver into which the connector of the illustrated embodiment may be inserted.

Figure 5:
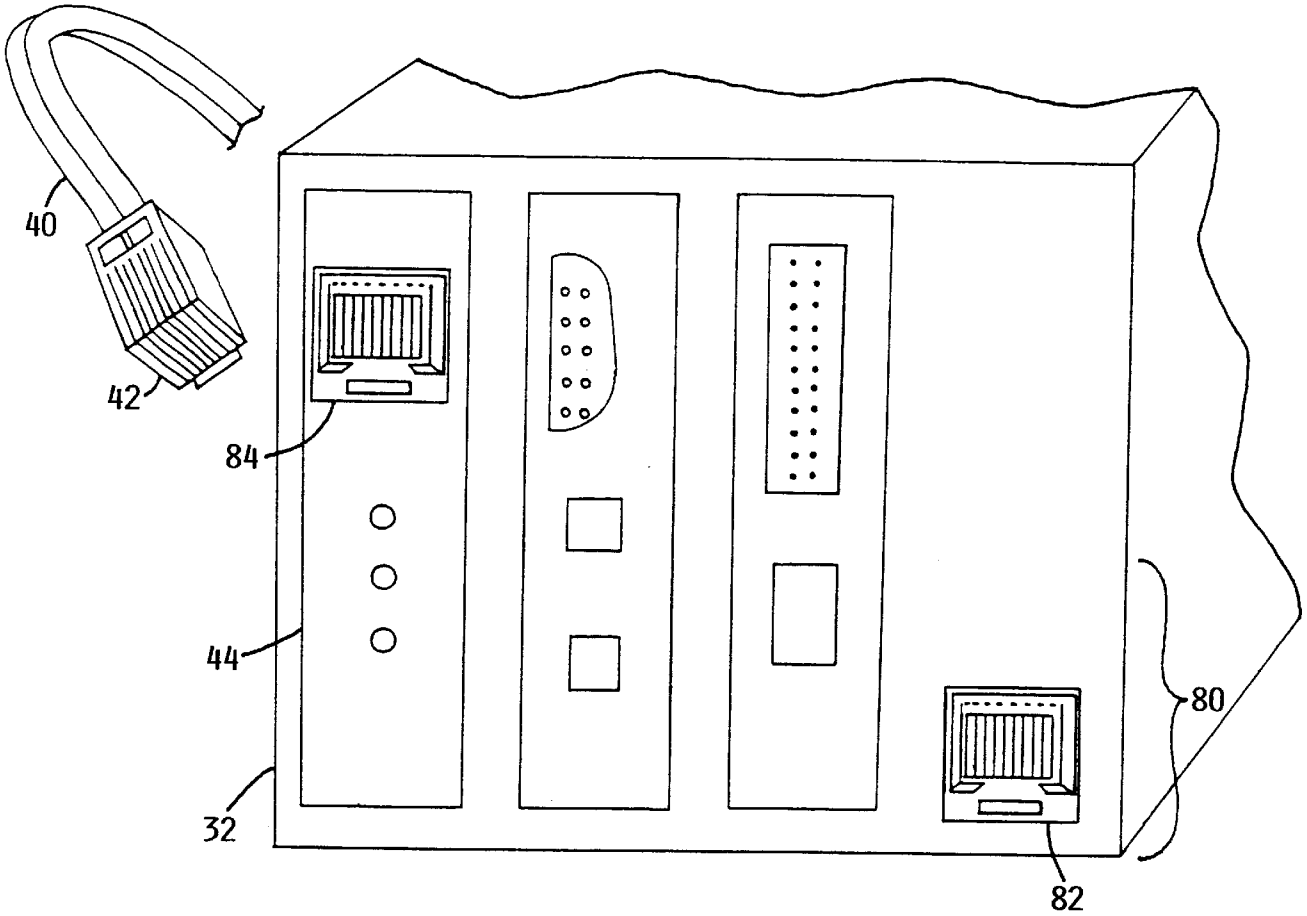
FIG. 5 illustrates a third embodiment of the grounding apparatus, wherein the grounding apparatus is integrated into a computer system containing the network device.

FIG. 5 illustrates a third embodiment of a grounding device, shown generally at 80. In this embodiment, grounding device 80 is integrated into computer system 32 containing the network device 44. Unlike the grounding device of FIG. 3A, the grounding device 80 of this embodiment includes a cable connector receiver 82 built into computer system 32 itself. In a preferred embodiment, the ground connection from grounding device is made directly to the frame of computer system 32 (not shown). The same two-step grounding process previously described in FIGS. 3A and 3B is also employed here (i.e., the cable connector 42 of the charged twisted pair cable 40 is inserted into cable connector receiver 82 to discharge twisted pair cable 40, then twisted pair cable 40 is removed from cable connector receiver 82 and inserted into a cable connector receiver 84 of network interface card 44).

Figure 6:
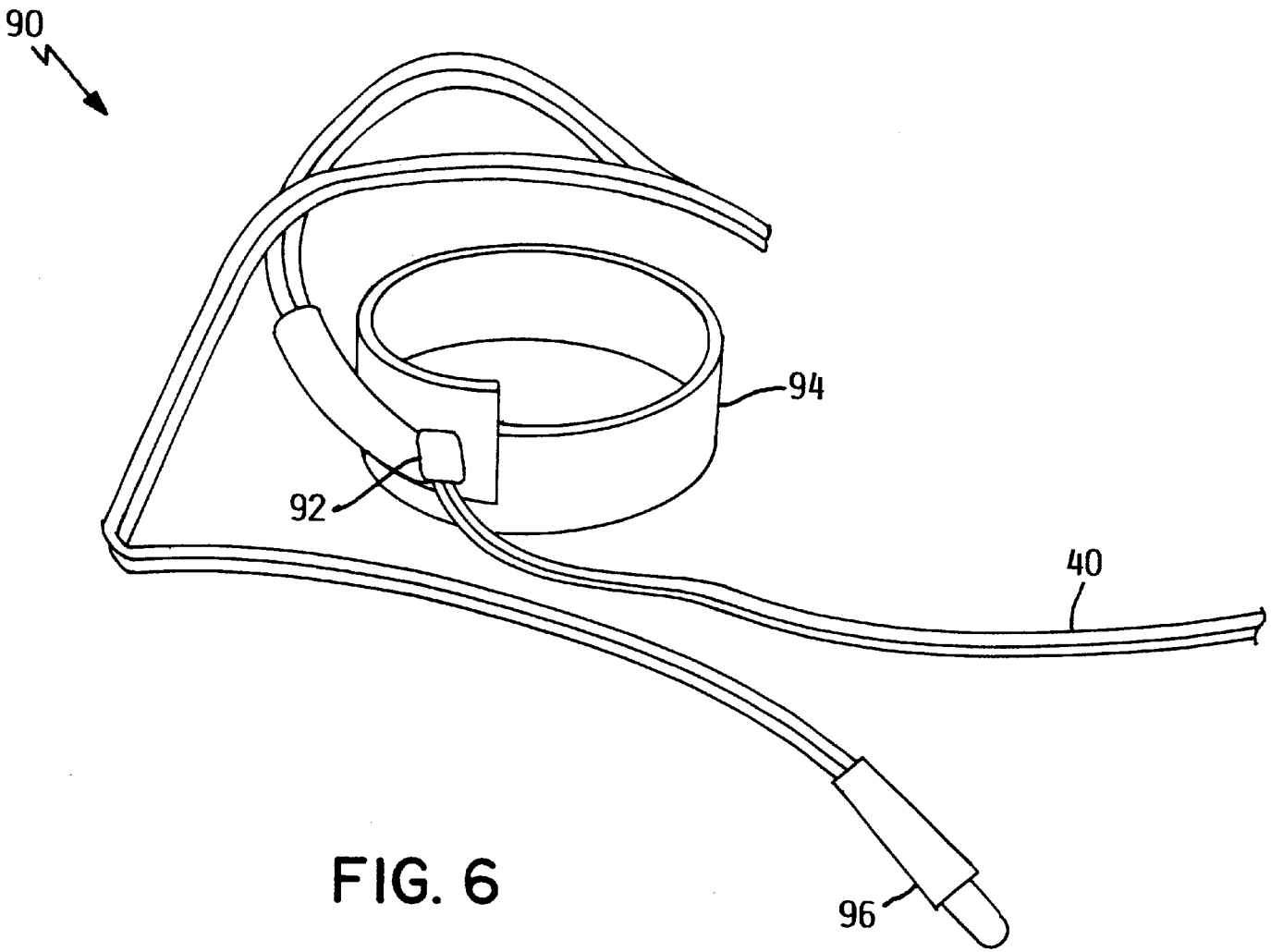
FIG. 6 illustrates a fourth embodiment of the grounding apparatus, wherein the grounding apparatus is integrated into a grounded wrist strip.

FIG. 6 illustrates a fourth embodiment of the grounding device, illustrated generally at 90, wherein the grounding device 92 is integrated into a grounded wrist strip 94. Grounded wrist straps 94 are commonly employed by technicians who work in areas where ESD events commonly occur and cannot be tolerated. In a typical embodiment, wrist strap 94 connects the skin of a wearer (a large conductor) to a common potential (usually electrical ground) through a ground connector 96. Properly worn, the wrist strap should fit snugly, making proper contact with the skin, to reduce contact resistance. Since wrist strap 94 is connected to electrical ground, it quickly discharges any excess charge the body of the wearer accumulates. Any time the body of the wearer directly touches a charged conductor, a discharge occurs, because the body is at a different potential (i.e., ground potential).

The electrical properties of the body of a wrist strap wearer can have a wide range in both resistance and capacitance depending on several variables. A wrist strap wearer's hand touching a charged device initiates a discharge at the rate of the time constant of the skin before including the RL properties of wrist strap 94. To reduce the potential of an unsafe discharge from a device to a very conductive wrist strap wearer, adding resistance to the wearer at the interface from the wearer's skin to the wrist strap may be necessary. Some solutions are static dissipative gloves or finger cots, which if worn properly, may add from 1 to 10 megaohms to the RC circuit of the skin. This slows down the discharge rate of well over 2 milliseconds.

In the illustrated embodiment, a cable connector receiver 92 is integrated into the grounded wrist strap 94, such that when cable 40 is plugged into cable connector receiver 92, any excess electric potential present on cable 40 is grounded via common ground connector 96. Wrist strap 94 includes a current limiting device (FIG. 2, element 50) for coupling cable connector receiver 92 with common ground connector 96, as described previously. Thus, this embodiment of the grounding device serves the dual role of discharging both cable 40 and the technician via a shared ground connector 96.

The present invention, therefore, is well adapted to carry out the objects and attain the ends and advantages mentioned, as well as others inherent therein. While preferred embodiments of the present invention are described for the purpose of disclosure, numerous other changes in the details of construction, arrangement of parts, compositions and materials selection, and processing steps can be carried out without departing from the spirit of the present invention, which is intended to be limited only by the scope of the appended claims.

What is claimed is:

1. An apparatus for grounding an electrostatically charged cable prior to connection to a voltage sensitive device, the apparatus comprising:

a cable connector receiver for receiving an end of the cable;

a current limiting device coupled to the cable connector receiver for substantially eliminating any electric potential present on the cable; and a ground connector having a first end and a second end, the ground connector coupled to the current limiting device at the first end, and to an electrical ground at the second end, the ground connector providing an electrical discharge path to the electrical ground for any electric potential present on the cable.

2. The apparatus of claim 1, wherein the cable includes one or more twisted pairs of signal lines.

3. The apparatus of claim 1, wherein the cable connector receiver is designed to receive a Registered Jack-45 (RJ-45) connector.

4. The apparatus of claim 1, wherein the cable connector receiver is designed to receive a Registered Jack-11 (RJ-11) connector.

5. The apparatus of claim 1, wherein the cable is shielded.

6. The apparatus of claim 1, wherein the cable is unshielded.

7. The apparatus of claim 6, wherein the unshielded cable is a Category 5 (Cat-5) network cable.

8. The apparatus of claim 6, wherein the unshielded cable is a Category 5 enhanced network cable.

9. The apparatus of claim 6, wherein the unshielded cable is a Category 3 (Cat-3) network cable.

10. The apparatus of claim 1, wherein the current limiting device comprises a plurality of resistors, each resistor coupled to one of the twisted pair signal lines at the cable connector.

11. The apparatus of claim 10, wherein the resistance value for each of the plurality of resistor ranges from approximately 1 megaohm to approximately 10 megaohms.

12. The apparatus of claim 1, wherein the current limiting device comprises a plurality of diodes, each diode coupled to one of the signal lines at the cable connector.

13. The apparatus of claim 1, wherein the second end of the ground connector includes a coupler for coupling the ground connector to the electrical ground.

14. The apparatus of claim 13, wherein the means for attaching the ground connector to the electrical ground is an alligator clip.

15. The apparatus of claim 13, wherein the means for attaching the ground connector to the electrical ground is a circular ground lug.

16. The apparatus of claim 13, wherein the means for attaching the ground connector to the electrical ground is a banana plug.

17. The apparatus of claim 13, wherein the means for attaching the ground connector to the electrical ground is via a grounded wrist strap.

18. The apparatus of claim 1, wherein the voltage sensitive device is a network device.

19. The apparatus of claim 18, wherein the network device is a network hub.

20. The apparatus of claim 18, wherein the network device is a router.

21. The apparatus of claim 18, wherein the network device is a switch.

22. The apparatus of claim 18, wherein the network device is a bridge.

23. A computer system having a plurality of voltage sensitive input/output (I/O) ports coupled to an internal bus for providing a communication path between the computer system and an external device, the computer system further comprising:

a voltage discharge device for grounding an electrostatically charged twisted pair cable having a voltage potential prior to connecting the twisted pair cable to one of the plurality of sensitive input/output ports, the voltage discharge device further comprising:

a cable connector receiver for receiving an end of the twisted pair cable;

a current limiting device coupled to the cable connector receiver for substantially eliminating any electric potential present on the twisted pair cable; and a ground connector having a first end and a second end, the ground connector coupled to the current limiting device at the first end, and to an electrical ground at the second end, the ground connector providing an electrical discharge path to the electrical ground for any electric potential present on the twisted pair cable.

24. The apparatus of claim 23, wherein the cable connector receiver is designed to receive a Registered Jack-45 (RJ-45) connector.

25. The apparatus of claim 23, wherein the current limiting device comprises a plurality of resistors, each resistor coupled to one of the twisted pair signal lines at the cable connector.

26. The apparatus of claim 25, wherein the resistance value for each of the plurality of resistors ranges from approximately 1 megaohm to approximately 10 megaohms.

27. The apparatus of claim 23, wherein the current limiting device comprises a plurality of diodes, each diode coupled to one of the signal lines at the cable connector.

28. A method for grounding an electrostatically charged cable prior to connection to a voltage sensitive device via a current limiting device, the current limiting device including a cable connector receiver for receiving an end of the charged cable, and a ground connector for coupling the current limiting device to electrical ground, the ground connector providing an electrical discharge path to the electrical ground for any electric potential present on the charged cable, the method comprising the steps of:

inserting an end of the charged cable into the cable connector receiver of the current limiting device, transforming the charged cable into a discharged cable;

removing the discharged cable from the cable connector receiver of the current limiting device; and inserting an end of the discharged cable into the voltage sensitive device.

* * * * *